United States Patent [19]

Inwood

[11] Patent Number: 4,538,996

[45] Date of Patent: Sep. 3, 1985

[54] JET PROPELLED BOAT

[75] Inventor: Thomas J. Inwood, Arden Hills, Minn.

[73] Assignee: Surf-Jet Corporation, St. Paul, Minn.

[21] Appl. No.: 464,851

[22] Filed: Feb. 8, 1983

[51] Int. Cl.[3] ..... B63H 11/08

[52] U.S. Cl. ..... 440/38; 440/41; 440/900

[58] Field of Search ..... 440/38, 39, 40, 41, 440/42, 47, 53, 54, 55, 89, 900; 114/150, 151, 270; 244/23 D, 12.5

[56] References Cited

U.S. PATENT DOCUMENTS

| | | | |
|---|---|---|---|
| 1,734,911 | 11/1929 | King et al. | 440/89 |
| 3,030,909 | 4/1962 | Barnes et al. | 440/41 |
| 3,105,353 | 10/1963 | Schulz | 440/41 |
| 3,295,490 | 1/1967 | Hiatt | 440/41 |
| 3,302,605 | 2/1967 | Kuether | 440/42 |
| 3,680,315 | 8/1972 | Aschauer et al. | 440/41 |
| 4,223,630 | 9/1980 | Keeney | 114/151 |
| 4,274,357 | 6/1981 | Dawson | 114/270 |

*Primary Examiner*—Galen L. Barefoot
*Assistant Examiner*—Edwin L. Swinehart
*Attorney, Agent, or Firm*—Kinney & Lange

[57] ABSTRACT

A jet propelled boat whose propulsion unit is very compact vertically and in which entrance of the water into the exhaust system is effectively prevented. The jet propulsion unit includes an engine having a vertical output shaft, an impeller housing secured to the engine beneath the same and housing an impeller driven by the engine, and an exhaust gas housing surrounding the impeller housing having the walls thereof spaced from the impeller housing sufficiently to form a gas chamber, this exhaust gas housing being connected to the exhaust gas discharge below the normal water line and also to the exhaust manifold. The propulsion unit may be used either in connection with an inboard engine or with an outboard engine. In either case, provision is made for changing the direction of the boat and for reversing the same.

In the case of the outboard engine, there is combined in one housing below the propulsion unit, a water intake for the impeller, an arrangement for exhausting the exhaust gas quietly and an arrangement for reversing the flow of water issuing from the jet nozzle when it is desired to reverse the boat. In the inboard form of the device, an arrangement is provided for reversing the discharge nozzle to reverse the direction of the boat, this arrangement discharging the water immediately below the boat without the nozzle extending below the boat.

10 Claims, 9 Drawing Figures

JET PROPELLED BOAT

BACKGROUND OF THE INVENTION

1. Field of the Invention

This invention is concerned with a jet propelled boat having an improved propulsion unit.

2. Description of the Prior Art

Jet propulsion units for boats have been used for many years and such units usually consist of a pump driven by a conventional gas engine. Water is drawn through an inlet into an impeller housing and is discharged by the impeller at the stern of the boat. The advantage of these jet propelled boats is that it is possible to have practically no moving parts outside of the boat, particularly extending beneath the bottom of the boat. Thus, such boats can be used in very weedy areas and in other areas where the boat might encounter foreign objects that might damage a propeller, for example. For one to realize the full advantage of a jet propulsion unit, it is desirable that the unit be very compact vertically. The unit should not project much if any below the bottom of the boat and preferably should not extend much above the top of the transom. This is particularly important in fishing where it is desirable to have the area above the hull as free from obstructions as possible. A typical type of boat in which a very compact jet propulsion unit is used is shown in the Arnold U.S. Pat. No. 3,889,623. Another patent of interest in connection with this is the Smith U.S. Pat. No. 3,785,327.

The problem arises, whenever use is made of a jet propulsion unit that is very compact vertically, that the engine tends to be either below or close to the surface of the normal water line. It is customary in such boats to discharge the exhaust gas below the surface of the water. Under these conditions, it is very easy, when the boat is being loaded prior to starting the engine, for water to enter the exhaust system and even into the exhaust manifold. This is due to the fact that there is very little vertical distance between the level at which the exhaust gas is discharged and the level of the exhaust manifold. Obviously, if water enters into the exhaust manifold, it can seriously interfere with the operation of the engine and certainly with the initial starting of the engine.

One attempt to avoid the problem in connection with jet engines for boats is shown in the Mattson et al U.S. Pat. No. 3,194,205. In this patent, a pipe leading from the exhaust passage is brought up over the top of the propulsion unit before entering the exhaust manifold. This presents several problems, in the first place, it places a very hot pipe up near the top of the engine where, if the engine cover is removed, it is apt to be engaged by an occupant of the boat. Furthermore, the provision of such a long pipe between the exhaust gas outlet and the exhaust manifold greatly increases the exhaust gas back pressure and hence decreases the efficiency of the engine.

In the Dawson U.S. Pat. No. 4,274,357, assigned to the same assignee as the present invention, there is shown a jet propulsion unit for operation of a surfboard. Because of the necessity of having a relatively compact unit, the distance between the engine and the impeller is relatively small. Dawson overcomes the problem of water entering through the exhaust gas outlet into the exhaust manifold by providing a cushion chamber around the impeller housing and through which the exhaust gas flows. Because of the large diameter of the cushion chamber, there is relatively little pressure drop. Furthermore, the chamber, being sealed tight, provides a very effective gas cushion to guard against entrance of water. There is no recognition in the Dawson Patent that the jet engine of that patent might solve the problems in connection with a propulsion unit for a conventional boat. I have discovered that an engine of the type shown in the Dawson Patent with a vertical shaft and a gas chamber around the impeller housing if used as a propulsion unit for a boat solves many of the problems previously encountered in connection with trying to provide a jet propulsion unit for a boat which is compact vertically and which does not allow water to enter the exhaust manifold system when the boat is standing still and someone is standing in it.

SUMMARY OF THE INVENTION

The present invention is concerned with a jet propelled boat in which the propulsion unit is very compact vertically and yet in which entrance of water into the exhaust system is effectively prevented. The invention is also concerned with a jet propelled unit in which a novel means is provided for reversing the boat and for discharging the exhaust gas.

Specifically, the jet propulsion unit includes an engine having a vertical output shaft, an impeller housing secured to the engine beneath the same and housing an impeller driven by the engine, and an exhaust gas housing surrounding the impeller housing having the walls thereof spaced from the impeller housing sufficiently to form a gas chamber, this exhaust gas housing being connected to the exhaust gas discharge below the normal water line and also to the exhaust manifold. In this way, it is possible to obtain the benefits of a jet propelled boat without the possible drawback of water entering the exhaust manifold.

The invention also involves the provision of a novel housing beneath the propulsion unit in which the discharge water may be directed to reverse the direction of the boat. The same housing includes an exhaust gas chamber into which exhaust gas is delivered. Both the water discharge chamber of the housing and the exhaust gas chamber have side openings to reduce the noise of the water and of the exhaust gas. In one form, a novel sliding diverter is used to divert the water into the water discharge chamber when the reverse operation of the boat is desired. The housing may also include a compartment for admitting water to the intake of the impeller.

The present invention, while particularly applicable in connection with an outboard propulsion unit, may also be used in connection with an inboard propulsion unit.

Various other features of the invention will be apparent from a consideration of the accompanying specification, claims and drawings.

BRIEF DESCRIPTION OF THE DRAWINGS

Referring to the drawings.

DETAILED DESCRIPTION OF THE PREFERRED EMBODIMENTS

Figure 1:
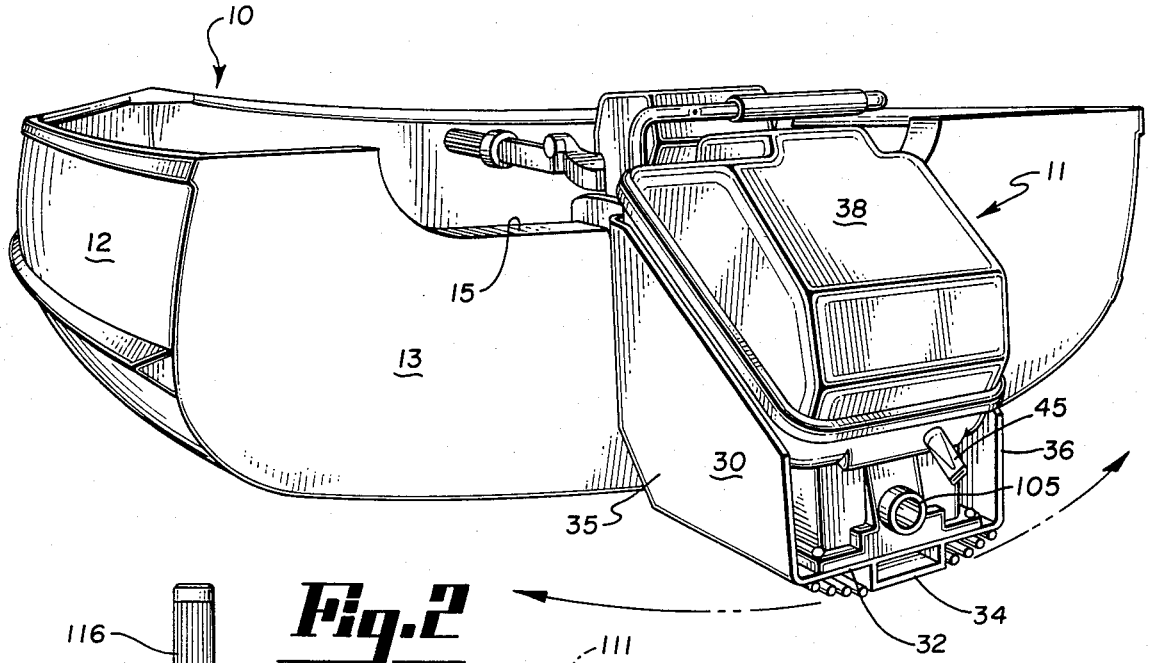
FIG. 1 is a rear perspective view of my invention used as an outboard engine and shown as being secured to the rear transom of the boat.

In FIG. 1 of the drawings, a boat employing my improved propulsion system is indicated by the reference numeral 10. The propulsion unit is indicated by the reference numeral 11. The boat 10 has the usual hull 12 at the stern of which is a transom 13. The transom is cut away at 15 to receive the clamp which supports the propulsion unit, as is common in boats employing outboard motors.

The modification shown in FIGS. 1–8 is a modification in which the propulsion unit is mounted as an outboard engine to the rear of the transom 13. The propulsion unit 11 is secured to the transom 13 by a clamp 18 very similar to that used in connection with outboard motors. The clamp 18 is provided with a clamping screw 19.

Pivotally supported to the clamp 18 is a tubular bar 22 which is pivotally connected at 20 to the clamp 18. The angular position of the clamp 18 with respect to the vertical tubular bar 22 is adjustable by means of a series of holes 23 (FIG. 3) provided in the clamp 18 which cooperate with a hole in the wall of tubular vertical bar 22. By inserting a pin 24 through a selected one of the openings 23, the angular position of the bar 22 with respect to the clamp 18 can be adjusted. In the modification shown in FIGS. 1–3, the transom 13 slopes rearwardly from the bottom to the top. A pin 24 is accordingly shown as being inserted through the extreme right-hand opening 23 so that despite the slope of the transom 13, the tubular bar 22 is in a substantially vertical position. The bar 22 is swivelly secured to a slidable bar 25 which is adapted to be adjustably fastened to a bar 26. The bar 26, as will be presently explained, carries the primary propulsion unit. The bar 25 has a plurality of openings 27 therethrough and the bar 26 has a series of correspondingly spaced openings 28. The two bars 25 and 26 are slidable with respect to each other and are secured in adjusted position by nuts and bolts 29. By selecting which openings 28 and 27 the nuts and bolts 29 are passed through, the vertical height of the propulsion unit can be adjusted.

Secured to the vertical apertured bar 26 is a shell 30, having a rear wall 31 secured to the bar 26. The shell 30 has a bottom wall 32 through which a water intake aperture 33 extends. A portion of the bottom wall 32 is turned downwardly to form a exhaust gas discharge portion 34. The shell 30 has side walls 35 and 36, best shown in FIG. 1. The entire engine and impeller assembly is supported by shell 30.

Within the shell 30 is an engine 42, an exhaust gas housing 43 and an impeller housing 44. Means such as a fuel tank located in the boat is provided for supplying fuel to the engine. The engine 42 is enclosed by a belly pan 47 having a bottom wall 48 mounted on the exhaust gas housing 43, a pair of side walls 49 (only one of which is shown) and a rear wall 50. The belly pan 47 is provided with a cover 52 which covers the belly pan and provides a water-tight compartment around the engine to prevent water from being splashed onto the engine so as to impair the operation of the engine. The engine rests upon the bottom wall 48 of the belly pan which, as previously explained, rests on top of the exhaust gas housing 43.

The engine 42 is a conventional internal combustion engine which in a typical case is a two cylinder engine. The engine has a retractable hand-operated starting mechanism 55 with a starting cable 56 which is extended over a pair of pulleys and is provided with a starting handle 57 which is accessible within the boat and which can be pulled out to start the engine. This starting mechanism is a conventional arrangement and need not be described in detail. The engine is also provided with a control box 58 containing an ignition switch and any other controls such as a choke control and a throttle for controlling the operation of the internal combustion engine. The engine is also provided with the usual carburetor 64 having an air intake through an air cleaner 65.

The engine is also provided with the usual spark plugs and ignition cables 66 and 67 leading to the spark plugs. The engine is provided with a conventional exhaust manifold having an exhaust pipe 72 connected to the manifold. The engine is provided with a vertical output shaft 83 on which is secured the impeller as will be presently described.

Referring to the exhaust gas housing 43, this housing rests upon and is secured to the bottom wall 32 of the shell 30. This is a gas-tight housing and is secured to the floor 32 by any suitable fastening means. The belly pan 47 rests upon and is secured to the exhaust gas housing 43. The housing 43 thus supports the engine. The exhaust gas chamber 43 is secured in a gas tight manner to the impeller housing 44. Secured to the rear of the belly pan 47 is a one-way valve 45 which permits any water in the belly pan to drain out of it but which prevents the entrance of water into the belly pan.

Figure 3:
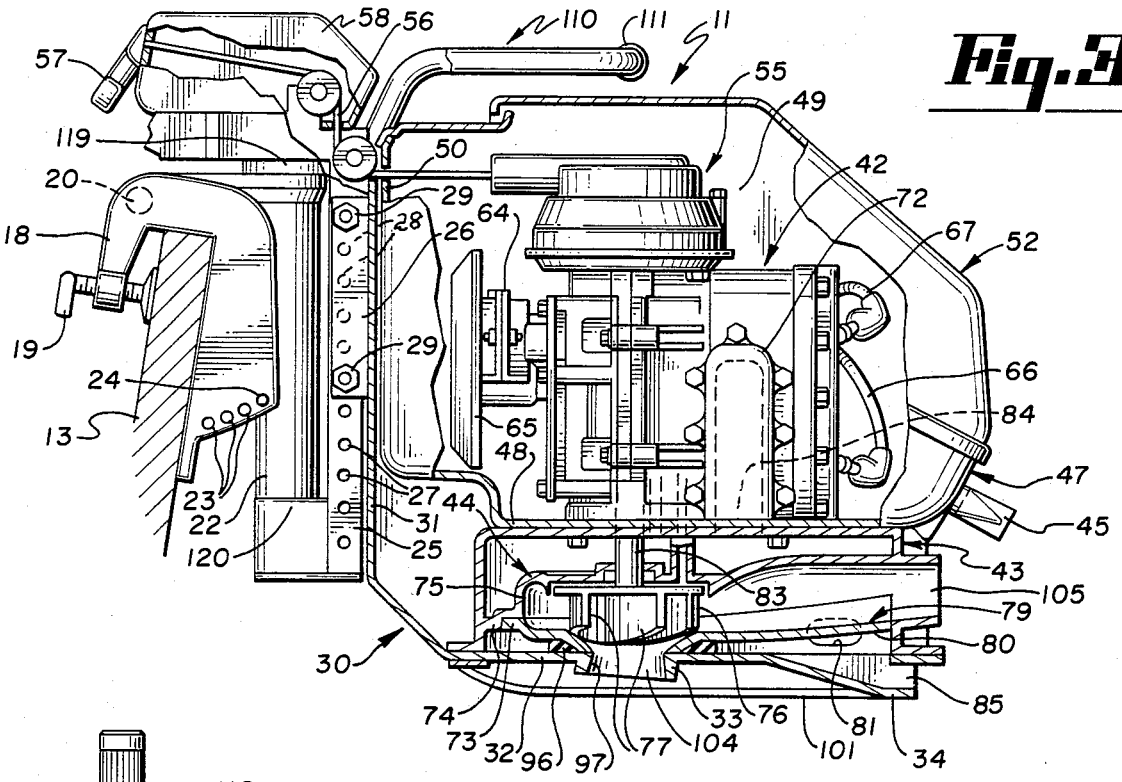
FIG. 3 is a side elevational view similar to that of FIG. 2 but with portions broken away and portions shown in section.
Figure 4:
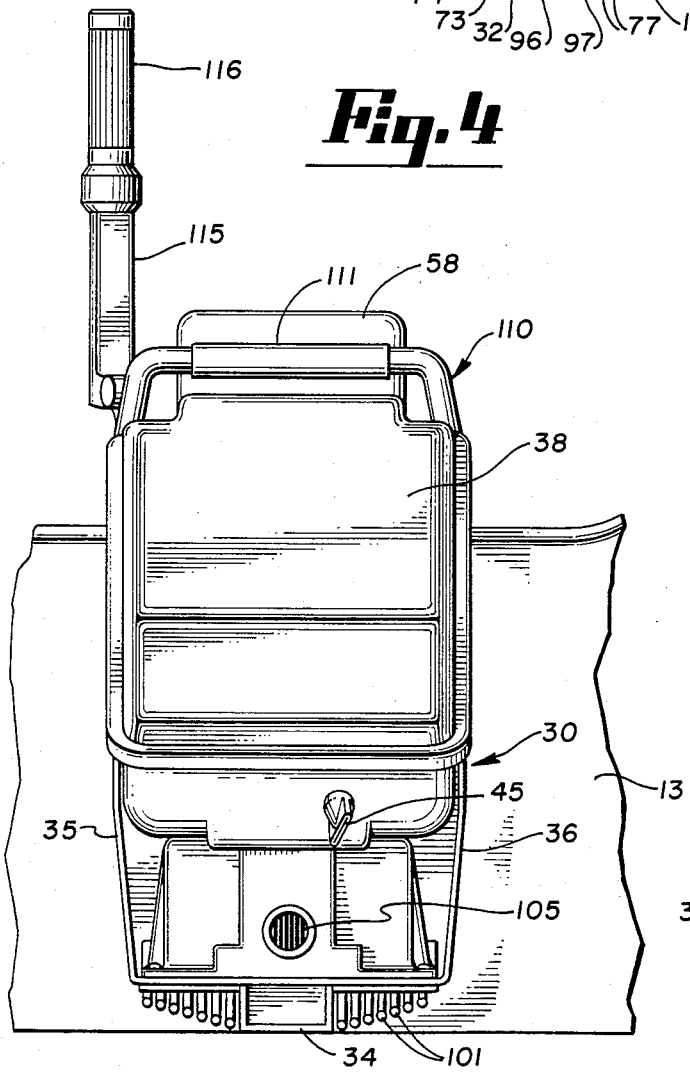
FIG. 4 is a rear elevational view of the propulsion unit shown in FIG. 1 with only a portion of the boat being shown.

Referring to the impeller housing 44, this is best shown in FIG. 3. It should be noted that it has a central portion 75 in which is located the impeller 76. The impeller 76 is mounted on the cover end of the vertical output shaft 83 of the engine. Because the vertical shaft of the engine is very short and because the engine and the impeller housing are both securely fastened to exhaust gas housing 43, there is a minimum of vibration.

The impeller housing 44 has a externally extending flange 73 extending completely around the periphery of housing 44 up to the point where it extends through the rear wall of housing 43. The flange is secured in a gas-tight manner to a flange 74 extending inwardly from the housing 43 and integral with the housing. The flanges 73 and 74 collectively form a partition separating the upper portion of housing 43 from the lower portion.

The upper portion of exhaust gas housing 43 has an opening 84 which communicates with the exhaust pipe 72 leading from the exhaust manifold. Thus, the exhaust gas leaving the exhaust manifold passing through the exhaust pipe 72 enters the area above the impeller housing 44. The area of the exhaust gas housing 43 below the flanges 73 and 74 and below the impeller housing 44 communicates with a gas discharge chamber 85 within the gas discharge portion 34. Gas passes between the upper chamber through an opening 81 outside of the impeller housing and bypassing the partition 84 by the flanges 73 and 74.

Referring back to the intake of the impeller housing 34, this has a neck portion 97 surrounding the intake opening 104. A gasket 96 is interposed between the bottom wall 32 of the shell 30 and the lower portion of the impeller housing 44 to form a water-tight seal.

Figure 2:
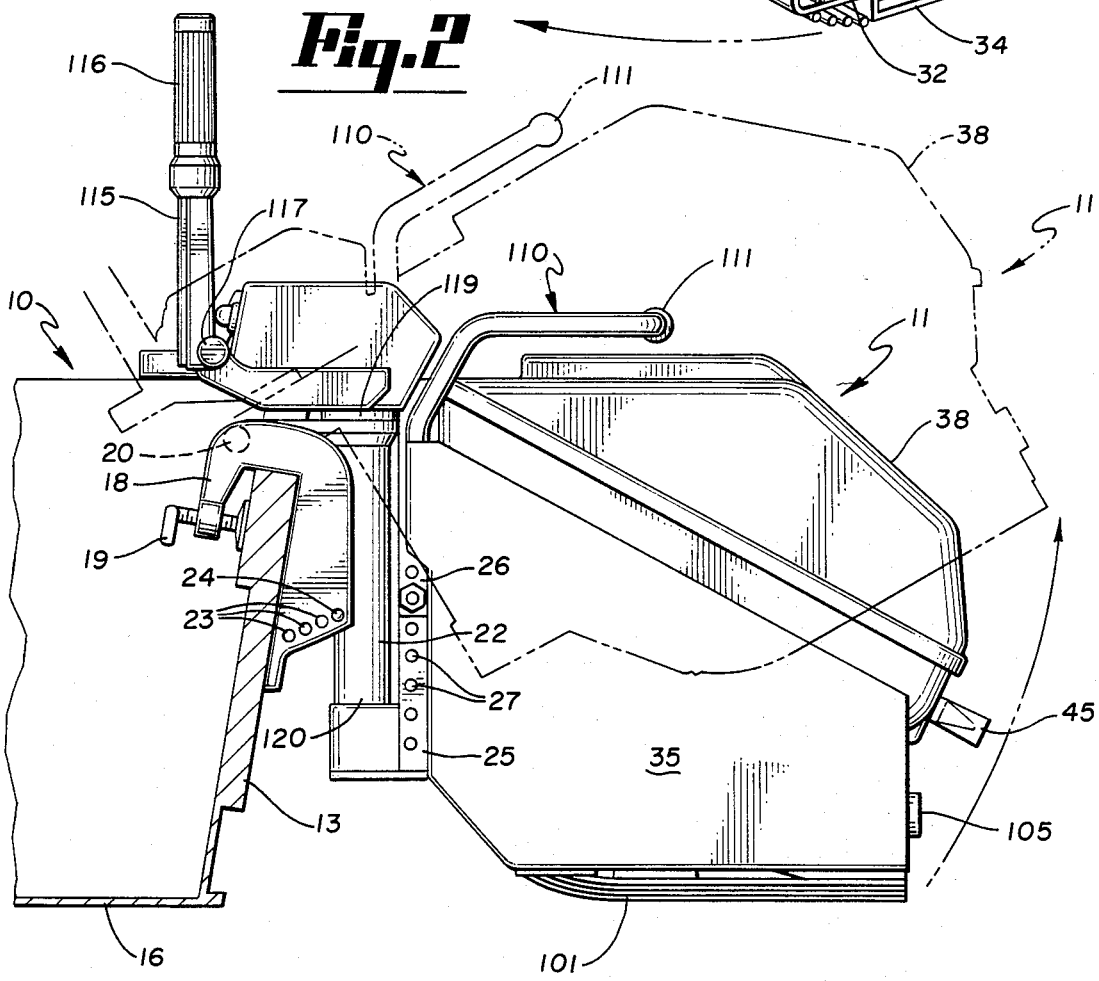
FIG. 2 is a side elevational view of the rear portion of the boat of FIG. 1, with a portion of the boat being shown in section.
Figure 5:
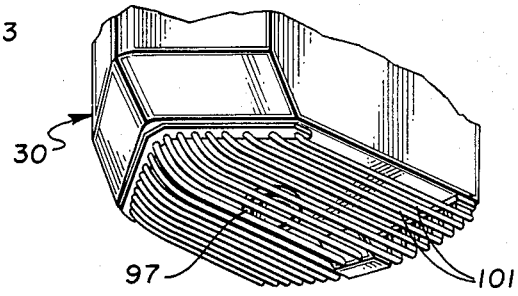
FIG. 5 is a detailed perspective view showing the screen extending over the water intake passage.

Referring to the intake chamber 97, curved bars 101 extend over the intake opening 104. These bars are curved as best shown in FIGS. 3 and 5 and are secured at their front end to the shell 30 and are free at their rear end as best shown in FIG. 5. These curved bars act to prevent weeds or other foreign objects from entering the impeller housing. Furthermore, they provide a safety factor in that human hands cannot be inserted into the impeller housing. This could cause severe injury to the human. Furthermore, if hard foreign objects were drawn into the impeller, damage to the impeller might result. Basically, as shown in FIG. 2, these weed guards 101 extend only slightly below the bottom 16 of the boat so that the weed guards will not be apt to engage any foreign objects which have not been cleared by the bottom of the boat. The advantage of the type of engine propulsion unit shown in this application is that it is possible to use the boat in very weedy water or water in which there are a large number of foreign objects. By having a very compact propulsion unit such as shown and by having it project only slightly below the bottom of the boat, the boat is able to go through water, through which a conventional type boat employing a propeller could not go. Such weed guards of the type formed by bars 101 are old and well known.

As the boat moves forward, water is scooped up through the opening 104 and is directed upwardly through the opening into the impeller 76. The water entering the intake chamber is forced out by the impeller through the discharge nozzle 105 to cause the boat to move forwardly.

As is conventional with outboard motors, means are provided for tilting the propulsion unit upwardly when it is desired to move it out of the water. As previously pointed out, the propulsion unit is supported from clamp 18 by a pivot 20 which enables the entire unit to be swung in a counterclockwise direction as viewed in FIG. 2. This is accomplished by a U-shaped handle 110 which is secured to the carriage 30. The handle 110 is provided with a grip 111. By grasping the grip 111 and pulling forwardly, the entire unit can be tipped in a counterclockwise direction as shown in FIG. 2 in which the dotted line position indicates the raised position of the unit.

Means are also provided for turning the propulsion unit to turn the direction in which the boat moves. This is done in a conventional manner by pivotally mounting the unit about pivots 119 and 120 and providing an arm 115 which is pivotally secured to the unit at 117 and has a handle 116. By tilting the handle 115 downwardly, it is possible to control the angular direction of the unit as shown by the arcuate line in FIG. 1.

Figure 6:
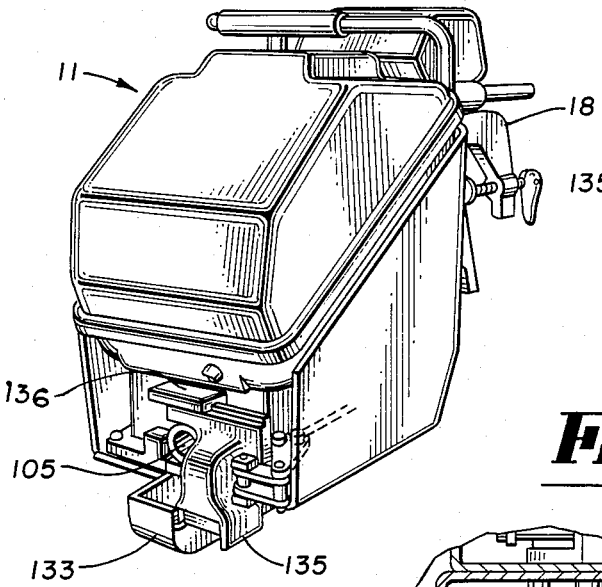
FIG. 6 is a rear perspective view of a portion of one form of mechanism for reversing the flow of water from the jet exhaust to reverse the direction of travel of the boat.
Figure 7:
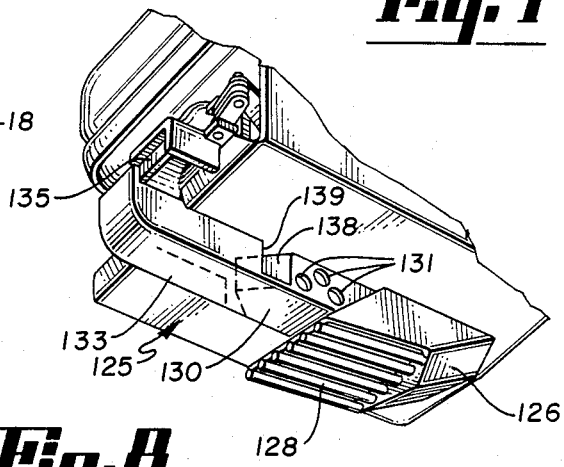
FIG. 7 is a bottom perspective view showing further details of the means for reversing flow of the water, showing the exhaust chamber underneath the boat and showing the relation of these two to the water intake passage of the arrangement of Figure.
Figure 8:
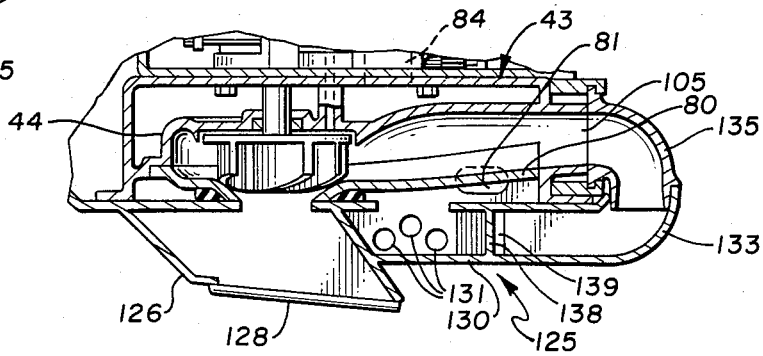
FIG. 8 is a detailed vertical sectional view showing the manner in which water enters the intake, gas leaves the exhaust and the reverse mechanism is used.

Any suitable means may be provided for reversing the boat. A typical arrangement is a clam shell which can come down over the outlet 105 and exert a thrust tending to move the boat backwardly. A specific form of an arrangement which I provide is shown in FIGS. 6, 7 and 8 and will be discussed presently.

Certain of the details of the engine have been omitted in the discussion. These details are not essential to the present invention and in this respect, the details are similar to those described in connection with a similar engine in the Dawson U.S. Pat. No. 4,274,357. These details are incorporated by reference to the present application.

As pointed out earlier in this specification, a very important feature of the present invention is the gas-tight exhaust chamber 43 which surrounds the impeller housing 44. To a greater extent than a surfboard which is basically above the water line, a boat, of necessity, extends substantially below the water line. If the propulsion unit is to terminate closely adjacent the bottom of the boat and if the exhaust gas is to be discharged into the water as is customary with such units, it is obvious that the exhaust gas outlet will be well below the normal water level. Thus, the problem of preventing water entering the exhaust manifold is much more acute than with a surfboard. Furthermore, it is very customary in connection with a boat for considerable weight to be placed on the boat while it is being loaded. Fishermen will be loading fishing gear into the boat and often two or three people are in the boat loading the equipment prior to the engine being started. Thus, considerable downward pressure is being placed on the boat causing the boat to sink deeper in the water before the engine is even started. Thus, it is extremely important to provide a means for preventing water entering the exhaust pipe from passing into the exhaust manifold. The present arrangement has the very unique advantage that a cushion is provided to prevent water entering the exhaust manifold without increasing the back pressure during normal operation and without extending the height of the unit. As has been pointed out, it is very important in connection with such a jet operated power unit for a boat to have the overall height not substantially greater than that of the boat so that the unit does not project below the bottom of the boat and does not appreciably extend above the boat. The arrangement of the present invention accomplishes this in a very effective fashion.

As is mentioned above, it is desirable to provide means for actually reversing the operation of the boat. Turning can be provided for by turning the propulsion unit about a substantially vertical axis as has been described. This does not, however, take care of the reverse operation of the booat. It is obviously impossible to provide for rotating the propulsion unit through an angle of 360°. One common way of doing this is to provide a clam shell as pointed out above. In the arrangement of FIGS. 4, 5, 6, 7, and 8, I have shown an unique arrangement that not only provides for reversing the direction of flow of the boat, but does so in a manner which results in relatively low noise and also provides for relatively effective discharge of the exhaust gas as well as a means for admitting the water to the impeller. Referring first to FIG. 7 which shows the bottom of the propulsion unit, there is a three-part housing 125 secured on the underside of the propulsion unit. At the forward end of the housing 125 there is a compartment 126 which is under the intake opening for the impeller. Bars 128 corresponding in function to bars 101 are secured at the forward end of the housing and are preferably free at the rear end. These bars, like bars 101 are provided to prevent foreign objects such as weeds, stones and so forth from entering the intake opening to the impeller.

There is an intermediate section 130 which has a plurality of side openings 131. This intermediate section is an exhaust gas compartment. Turning to FIG. 8, it should be noted that the upper portion of this compartment is in communication with the lower portion of the exhaust gas chamber 43 below the lower wall 80 of the impeller housing 44. Thus, gas passing from the exhaust pipe through opening 84 into the exhaust gas chamber and through the opening 81 into the lower portion of the exhaust gas chamber can pass out into the exhaust gas compartment 130 of housing 125 and out through the openings 131. Such openings are provided on each side of the exhaust gas compartment 130. By providing side openings for the exhaust gas and by having these openings beneath the water level, the noise of the exhaust gas is considerably muffled.

There is a third compartment 133 in housing 125. This compartment is designed at its rear end to cooperate with a sliding elbow 135 which, as shown in FIG. 6, is guided for movement in the upper end of compartment 133 and a bracket 136. In the position shown in FIG. 6, the elbow is clear of the water exhaust outlet 105 and the boat operates in the normal manner. In other words, the effect of the water jet is to cause the boat to move forwardly. When, however, the slidable elbow 135 is moved to the left as viewed in FIG. 6, it assumes a position shown in FIG. 8 in which the water leaving the jet exhaust pipe 105 is directed through the elbow 135 into the water discharge housing 133. At the forward end of this housing, there is a triangular baffle 138 which is adjacent to and opposite two openings 139, only one of which is visible in the drawing. The water is deflected by the triangular baffle out through the two openings 139 and back alongside of the housing 125. Since the effect of this water is to force the boat backwardly, the movement of the slidable elbow 135 into the position shown in FIG. 8 causes the direction of movement of the boat to reverse.

The arrangement of FIGS. 6, 7 and 8 is very unique in that it provides in one housing, means for discharging the exhaust gas in a muffled manner, means for bringing in water into the intake for the impeller and means for reversing the boat in a manner which results in relatively quiet action. Because the water is forced out the two side openings 139, rather than hitting a baffle, there tends to be a minimum of noise resulting from the operation in the reverse direction.

MODIFICATION OF FIG. 9

Figure 9:
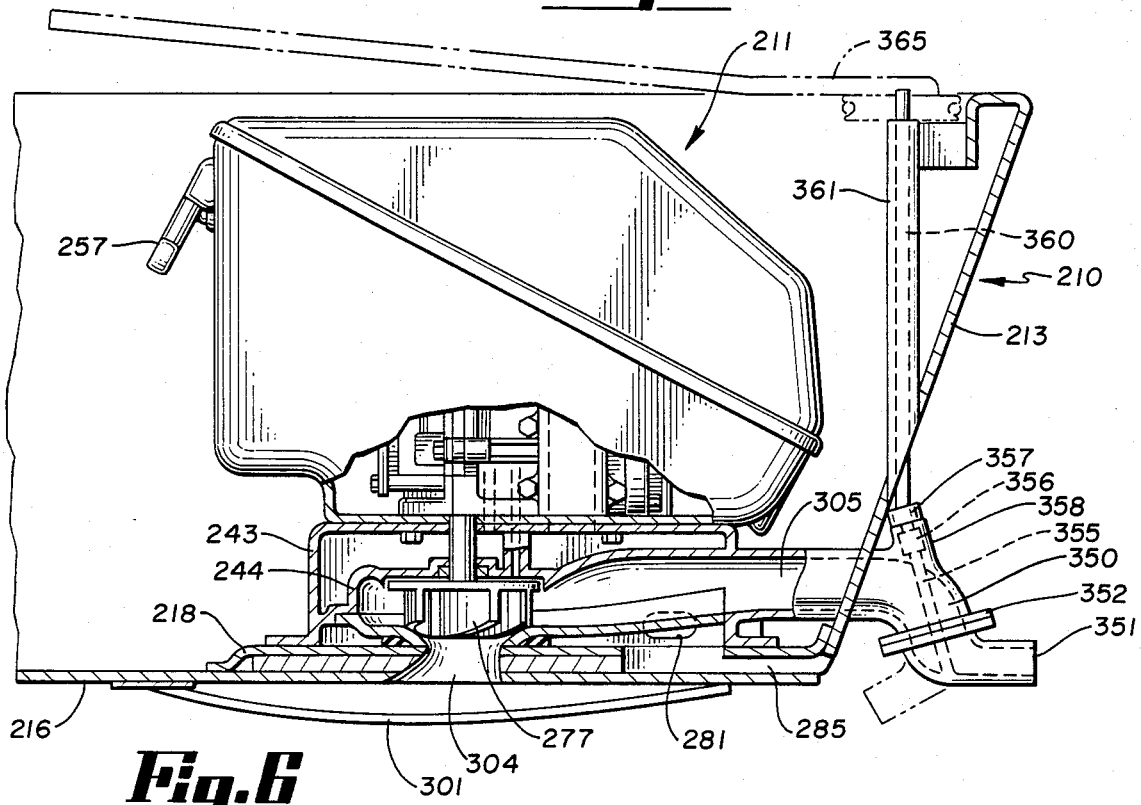
FIG. 9 is a vertical section of a modification of my invention embodied as an inboard engine in a boat.

In FIG. 9, I have shown an inboard form of my jet propelled boat. In order to enable a ready comparison between the elements of FIGS. 1–8 and the modification of the present invention, reference numerals 200 or higher have been assigned to the elements corresponding to those of the modification of FIGS. 1–5. Thus, the propulsion unit has been designated in its entirety by the reference numeral 211. It should be noted that this propulsion unit is within a boat 210 and except for the jet discharge and the means for controlling the same, it is all ahead of the transom 213.

It is not believed necessary to discuss the operation of the engine in detail. As indicated previously, the corresponding elements have numbers 200 or higher and the general similarities of the engine will be readily apparent. Instead of the exhaust gas housing 243 being supported by the bottom wall 32 of the shell 30, the exhaust gas housing 230 is supported by the floor 216, there being a bracket member 218 to rest on the floor 216 and which supports the impeller housing. Suitable insulation is shown between the upper wall of the bracket member 218 and the floor 216. The exhaust gas passes through a passage 285 which extends through the transom 213.

The arrangement of FIG. 9 provides for reversal in the operation of the boat by reversing the direction of the jet discharge nozzle. The jet discharge pipe 305 connects to an elbow 350 which in turn is coupled to another open-ended elbow 351. The two are swivelly connected together at 352. The two elbow sections 350 and 351 swivel with respect to each other about a plane which is inclined with respect to the horizontal as is clearly evident from FIG. 9. Rigidly secured to the interior of the lower section is rod 355 which passes through a bearing 356 to a universal joint 357. The bearing 356 and the universal joint 357 are secured within a boss 358 projecting upwardly from the elbow 350. A rod 360 is located within a tube 361 passing through the transom 213, being sealed thereto. The rod 360 is connected at its upper end to a tiller 365 which is accessible to the operator of the boat and which can be swung back and forth to turn the rod 360 and hence turn the lower rod 355 which is rigidly secured to the lower elbow section 351 which constitutes a discharge opening. As shown in dotted lines, it is possible to rotate the lower section 351 so that it discharging forwardly rather than rearwardly. Because of the incline plane about which the two sections 350 and 351 rotate, it is possible to effect such reversal without bringing the discharge stream against the boat or without having the discharge nozzle 351 appreciably below the bottom of the boat when the boat is reversing. It should be readily apparent that when the boat is being operated in the forward direction as shown in full lines in FIG. 9, the nozzle 351 does not extend appreciably below the bottom 304 of the boat. Furthermore, the nozzle 351 is directed in a direction generally parallel to the plane of the bottom of the boat, this direction being the most efficient in propelling the boat. When the nozzle is reversed, however, the jet stream is directed downwardly beneath the boat but in a direction generally forwardly of the boat to cause reverse operation of it.

Again, as with the outboard motor species, the exhaust gas chamber 243 surrounding the impeller chamber 244 effectively prevents water entering the exhaust outlet and passing up to the exhaust gas manifold. Thus, even though considerable weight is being placed on the boat during the loading operation prior to starting the motor, water will not enter the exhaust gas manifold. Furthermore, the arrangement provides for this without increasing the overall height of the unit which, as is evident from FIG. 9, does not extend above the transom 213. This is done without increasing the back pressure such as would occur if an elongated pipe were provided for conducting exhaust gas from the exhaust gas manifold to the exhaust gas outlet.

CONCLUSION

It will be seen that I have provided a jet propelled boat which, whether the engine is being used as an inboard or an outboard engine, guards against water entering the exhaust manifold. This is done in a very compact arrangement which does not extend appreciably below the bottom of the boat nor appreciably above the top of the transom of the boat. It can also be seen that I have provided a very novel means for effecting reversal of the operation of the boat and for combining in one housing the means for introducing water to the impeller, removal of the exhaust gas, and providing for reversal of the boat where the engine is being operated as an outboard engine type of boat.

While I have shown certain specific embodiments of the invention, it should be understood that the scope of the invention is limited solely by that of the appended claims.

What is claimed is:

1. A jet propelled boat having a hull in which is located a passenger compartment, and a transom at the stern of the boat, said boat having a propulsion unit secured to the boat, said propulsion unit comprising:

an internal combustion engine having a vertical output shaft extending below said engine, said engine having an exhaust passage;

an impeller housing rigidly secured to said engine beneath the same with a water intake passage member adjacent the bottom of the hull and a water discharge passage extending rearwardly from the transom at a vertical height approximately that of the bottom of the transom, said water intake passage member extending downwardly below said impeller housing to facilitate entry of water into said impeller housing;

an impeller in said impeller housing mounted for rotation about a vertical axis and having a vertical drive shaft connected to the output shaft of the engine;

An exhaust gas housing surrounding said impeller housing and having the walls thereof substantially spaced from the impeller housing to form a substantial gas chamber around said impeller housing, said exhaust gas housing being secured to said impeller housing in a substantially gas-tight manner, said gas chamber having an inlet opening communicating in substantially gas-tight relation with the exhaust passage of the engine and having an outlet opening;

a gas discharge compartment disposed between the water intake passage member and the water discharge passage at a vertical height approximating that of the bottom of the boat and substantially below the normal water line adjacent the boat, said gas discharge compartment being attached to the underside of said propulsion unit and having oppositely disposed side openings through said gas discharge compartment for discharging the exhaust gas sidewise into the water at the rear of the transom;

a shell enclosing the propulsion unit, the discharge side openings being disposed above the entrance to said water intake passage member and forwardly of the water discharge member;

means for securing said propulsion unit to the boat with the top of the transom and with the gas-tight housing at least partially below the normal water line, said exhaust gas chamber acting to provide a gas cushion therein to retard the entrance of water through said discharge means into the exhaust passage of the engine; and means for changing the angular direction of the discharge of water from said water discharge passage to change the direction of propulsion of said boat.

2. The jet propelled boat of claim 1 in which the propulsion unit is mounted on the rear of the transom of the boat with means for turning the propulsion unit about a substantially vertical axis to change the angular direction in which the boat is propelled.

3. The jet propelled boat of claim 2 in which there is a means for adjusting the height of the propulsion unit with respect to the transom to maintain the bottom of the propulsion unit at substantially the same vertical height as the bottom of the boat regardless of the height of the transom.

4. A jet propelled boat having a hull in which is located a passenger compartment, and a transom at the stern of the boat, said boat having a propulsion unit mounted on the rear of the transom, said propulsion unit comprising:

an internal combustion engine having a vertical output shaft extending below said engine, said engine having an exhaust passage;

an impeller housing rigidly secured to said engine beneath the same with a water intake passage adjacent the bottom of the hull and a water discharge passage extending rearwardly from the transom at a vertical height approximately that of the bottom of the transom;

an impeller in said impeller housing mounted for rotation about a vertical axis and having a vertical drive shaft connected to the output shaft of the engine;

a housing secured to the underside of the propulsion unit, said housing having a water discharge compartment directed to the front of the boat and having oppositely disposed side openings, and an adjacent gas discharge compartment, said gas discharge compartment having side openings;

movable deflecting means for deflecting the water issuing from the water discharge passage into said water discharge compartment when it is desired to have the boat move rearwardly, the water passing laterally out of the oppositely disposed side openings; and means connecting said gas discharge compartment to the exhaust passage of said engine so that the exhaust gas passes out through said side openings.

5. The jet propelled boat of claim 4 in which the movable deflecting means is slidable transversely between a front position in which the water issues directly out of the water discharge passage rearwardly of the boat to a second position in which the water is deflected into said water discharge compartment in a forward direction with respect to the boat.

6. The jet propelled boat of claim 4 in which there is a centrally disposed deflector with diverging sloping walls disposed in said water discharge compartment adjacent said side openings for deflecting the water outwardly through said side openings.

7. The jet propelled boat of claim 6 in which the housing on the underside of the propulsion unit has a third compartment disposed forwardly of the water discharge compartment and the gas discharge compartment, the third compartment being connected to the intake passage of the impeller housing and acting as a water intake for the impeller.

8. A jet propelled boat having a hull in which is located a passenger compartment, and a transom at the stern of the boat, said boat having a propulsion unit secured thereto, said propulsion unit comprising:

an internal combustion engine having a vertical output shaft extending below said engine, said engine having an exhaust passage;

an impeller housing rigidly secured to said engine beneath the same with a water intake passage adjacent the bottom of the hull and a water discharge passage extending rearwardly from the transom at a vertical height approximately that of the bottom of the transom;

an impeller in said impeller housing mounted for rotation about a vertical axis and having a vertical drive shaft connected to the output shaft of the engine;

an exhaust gas housing surrounding said impeller housing and having the walls thereof substantially spaced from the impeller housing to form a substantial gas chamber around said impeller housing, said exhaust gas housing being secured to said impeller housing in a substantially gas tight manner, said gas chamber having an inlet opening communicating in a substantially gastight relation with the exhaust passage of the engine and having an outlet opening;

discharge means disposed at a vertical height approximating that of the bottom of the boat and substantially below the normal water line adjacent the boat for discharging the exhaust gas into the water at the rear of the transom;

a shell enclosing the propulsion unit;

means for securing said propulsion unit to the boat with the top of the shell adjacent in height to the top of the transom and with the gas tight housing at least partially below the normal water line, said exhaust gas chamber acting to provide a gas cushion therein to retard the entrance of water through said discharge means into the exhaust passage;

means for changing the angular direction of the discharge of water from said water discharge passage to change the direction of the propulsion of said boat, said means comprising means mounting the propulsion unit on the rear of the transom of the boat in such a manner that the propulsion unit can be turned about a substantially vertical axis to change the angular direction in which the boat is propelled; and a water discharge compartment located beneath the propulsion unit and directed towards the front, said water discharge compartment having oppositely disposed side openings therein, and moveable deflecting means for deflecting the water issuing from the discharge passage into said water discharge compartment when it is desired to have the boat move rearwardly, the water passing into said compartment passing out of said openings, said compartment having a deflector with two diverging sloping walls facing said oppositely disposed side openings so that the water is divided and deflected in opposite directions out of said oppositely disposed side openings.

9. The jet propelled boat of claim 8 in which the movable deflecting means is slidable transversely between a position in which the water issues directly out of the water discharge passage rearwardly of the boat to a second position in which the water is deflected into said water discharge compartment in a forward direction with respect to the boat.

10. The jet propelled boat of claim 8 in which the housing beneath the boat also has a gas discharge compartment with side openings therein, said gas discharge housing being connected to the outlet opening of the exhaust gas housing.

* * * * *